US012324947B2

(12) United States Patent
Hansen

(10) Patent No.: US 12,324,947 B2
(45) Date of Patent: Jun. 10, 2025

(54) WORKOUT PLATFORM

(71) Applicant: Kurt Spence Hansen, Taylorsville, UT (US)

(72) Inventor: Kurt Spence Hansen, Taylorsville, UT (US)

( * ) Notice: Subject to any disclaimer, the term of this patent is extended or adjusted under 35 U.S.C. 154(b) by 101 days.

(21) Appl. No.: 18/165,723

(22) Filed: Feb. 7, 2023

(65) Prior Publication Data

US 2023/0249026 A1 Aug. 10, 2023

Related U.S. Application Data

(60) Provisional application No. 63/267,692, filed on Feb. 8, 2022.

(51) Int. Cl.
*A63B 21/00* (2006.01)

(52) U.S. Cl.
CPC ..... *A63B 21/4033* (2015.10); *A63B 2210/50* (2013.01)

(58) Field of Classification Search
CPC ... A63B 21/4033; A63B 2210/50; A63B 1/00; A63B 17/04; A63B 23/1218; A63B 23/1227; A63B 21/068; A63B 23/1236; A63B 2225/093; A63B 2225/10
See application file for complete search history.

(56) References Cited

U.S. PATENT DOCUMENTS 2,817,522 A * 12/1957 Margulies ..... A63B 17/00 482/145
3,201,119 A 8/1965 Fenner et al.
3,944,219 A * 3/1976 LoPresti ..... A63B 21/1645 482/38
7,125,371 B2 * 10/2006 Henderson ..... A63B 21/4035 482/142
9,259,612 B2 2/2016 Meister et al.
10,220,252 B2 * 3/2019 Jackson ..... A63B 21/4035
10,532,239 B1 * 1/2020 Suarez Monne ..... A63B 17/04
10,632,334 B1 4/2020 Hopperstad et al.
10,737,134 B2 8/2020 Anderson et al.
10,779,645 B2 9/2020 Siaperas
10,799,747 B2 10/2020 Saffaie
10,953,301 B2 3/2021 Brasch et al.
11,135,464 B2 10/2021 Ballestero
(Continued)

OTHER PUBLICATIONS https://www.merriam-webster.com/dictionary/strap (Year: 2024).*

*Primary Examiner* — Megan Anderson
*Assistant Examiner* — Andrew M Kobylarz
(74) *Attorney, Agent, or Firm* — Dunlap Bennett & Ludwig, PLLC

(57) ABSTRACT

An exercise equipment having a sleeved hinge bar that interconnects a pair of scissor legs so that they move, in unison, between a closed position/collapsed condition and an open position/expanded condition supporting the sleeved hinge bar along and elevated above a supporting surface. Each pair of legs has a front leg and a rear leg. The rear legs interconnect along their distal ends by a rear support bar. A base platform may be pivotably connected to the rear support bar by hinge straps so that the base platform moves between a vertical position in the collapse condition and a horizontal position in the expanded position so that a user may be supported by the base platform during exercise routines that rely on engaging the front legs.

8 Claims, 4 Drawing Sheets

(56) References Cited

U.S. PATENT DOCUMENTS

| | | | | |
|---|---|---|---|---|
| 11,154,739 | B2 | 10/2021 | Kistner et al. | |
| 11,446,535 | B1 | 9/2022 | Iverson et al. | |
| 2021/0346749 | A1* | 11/2021 | Kittel | A63B 1/00 |
| 2022/0016470 | A1 | 1/2022 | Seamans | |
| 2022/0219041 | A1 | 7/2022 | Briscoe | |
| 2022/0266084 | A1 | 8/2022 | Hoover | |

* cited by examiner

WORKOUT PLATFORM

CROSS-REFERENCE TO RELATED APPLICATION

This application claims the benefit of priority of U.S. provisional application No. 63/267,692, filed Feb. 8, 2022, the contents of which are herein incorporated by reference.

BACKGROUND OF THE INVENTION

The present invention relates to exercise equipment and, more particularly, to a workout platform.

Barbells and weightlifting plates are heavy and take up a considerable amount of space. Use traditional iron or steel weights in an apartment or on any wood-framed floor risks damaging such property. Also, to perform a full-body workout, many pieces of equipment are needed.

Workout rooms or exercise equipment typically requires attaching equipment to the wall or some special installation, which is impractical in a residence, especially a rented apartment. Exercise equipment tend to serve only limited muscle groups. Exercise equipment may also weigh several hundred pounds, can be difficult to control, and can damage floors. Installing equipment to a structure may not be permitted in rented property. If specialized installation instructions are not followed, damage may occur to equipment, or worse to the user.

As can be seen, there is a need for a compact workout platform which is collapsible, does not require installation, and may workout various muscle groups.

SUMMARY OF THE INVENTION

The present invention embodies exercise equipment that enables a variety of exercises to be performed therewith so that a variety of muscle groups may be targeted, wherein at the end of the exercise the exercise equipment collapses into a low-profile planar space. Accordingly, the exercise equipment is portable, easy to store, and easy to set up as it requires no installation. The exercise equipment is not easily damaged, nor does it threaten damaging surrounding property because of the lack of installation and setup involving moving the exercise equipment from the collapsed condition to an expanded condition.

When in the collapsed condition, the present invention may be hung on a wall or put away by being slid under a bed. When setup, it may be used for a wide variety of exercises including resistance exercises. Two sides of the equipment separate like sides of a step ladder, while a planar base folds down and becomes a base platform for a user. The user may stand on the base platform, or they may place an exercise bench or seat on the base platform to perform an exercise of their choice.

The exercise equipment may include a crossbar, each end of the crossbar is pivotably connected to a pair of legs that move between a closed position and an open position, forming an inverted V that supports the exercise equipment in this expanded condition. A central one-way hinge may connect each pair of legs to support the inverted V.

One leg of each pair of legs may provide pegs for facilitating different exercises. Each leg of each pair of legs may be connected to its complementary leg on the other side of the crossbar by way of a surface bar. The planar base may be connected to the rear surface bar by hinge straps that enable the planar base to move between a horizontal position in the expanded condition and a vertical position in the collapsed condition.

In one aspect of the present invention, an exercise equipment includes the following: a sleeved hinge bar interconnecting a pair of scissor legs so that they move, in unison, between a closed position/collapsed condition and an open position/expanded condition supporting the sleeved hinge bar along and elevated above a supporting surface; each pair of legs has a front leg and a rear leg; a rear support bar interconnects the rear legs along their distal ends; and a platform may be pivotably connected to the rear support bar so as to be movable between a vertical position in the collapse condition and a horizontal position in the expanded position, whereby a user is supported above the supporting surface by the platform during an exercise routine engaging the front legs.

In another aspect of the present invention, the exercise equipment further includes the following: one or more hinge straps operatively associating the platform with the rear support bar, wherein each hinge strap defines a hollow 9-shape, wherein a circular head of the 9-shape receives rear support bar, and wherein an open end of a leg of the 9-shape slidably receives an edge of the platform, wherein each hinge strap pivots about the rear support bar enabling movement of the platform between the horizontal position to the vertical position; further including: a front support leg interconnecting the front legs so that when the platform is in the horizontal position it is resting on both the front and rear support bars; a plurality of pegs spaced apart along a front face of each front leg; a bearing peg extending laterally outward from each front leg; a bearing covering each bearing peg, wherein the platform has a handle on opposing sides; and further including for each handle of the platform, a storage strap dimensioned to pass through the handle and around an adjacent pair of legs.

These and other features, aspects and advantages of the present invention will become better understood with reference to the following drawings, description, and claims.

DETAILED DESCRIPTION OF THE INVENTION

Figure 1:
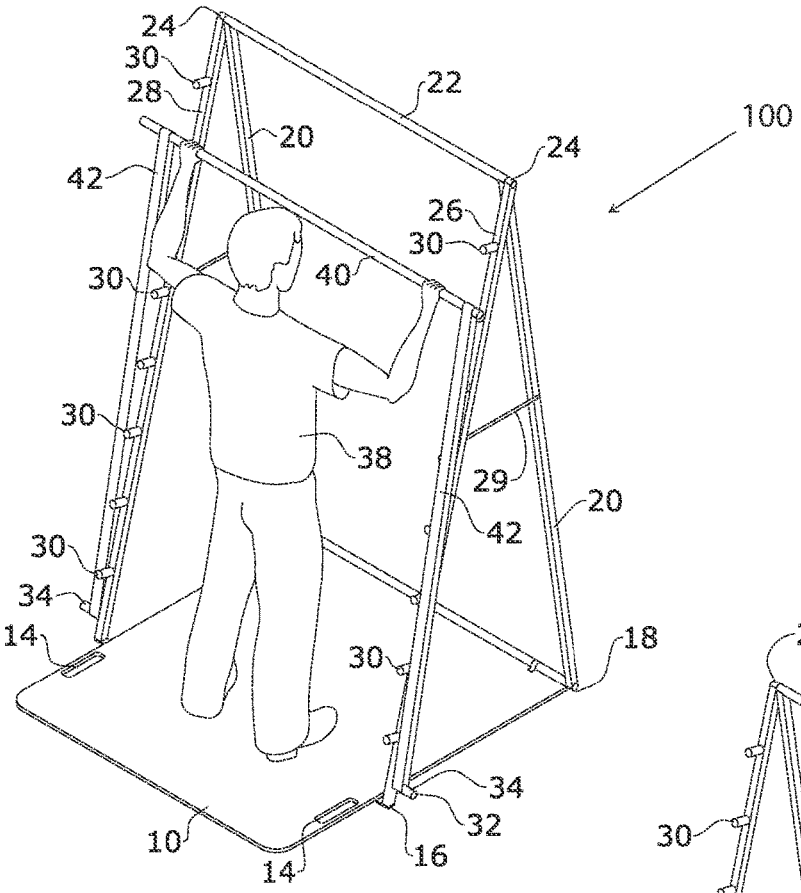
FIG. 1 is a perspective view of an exemplary embodiment of the present invention, shown in use.
Figure 2:
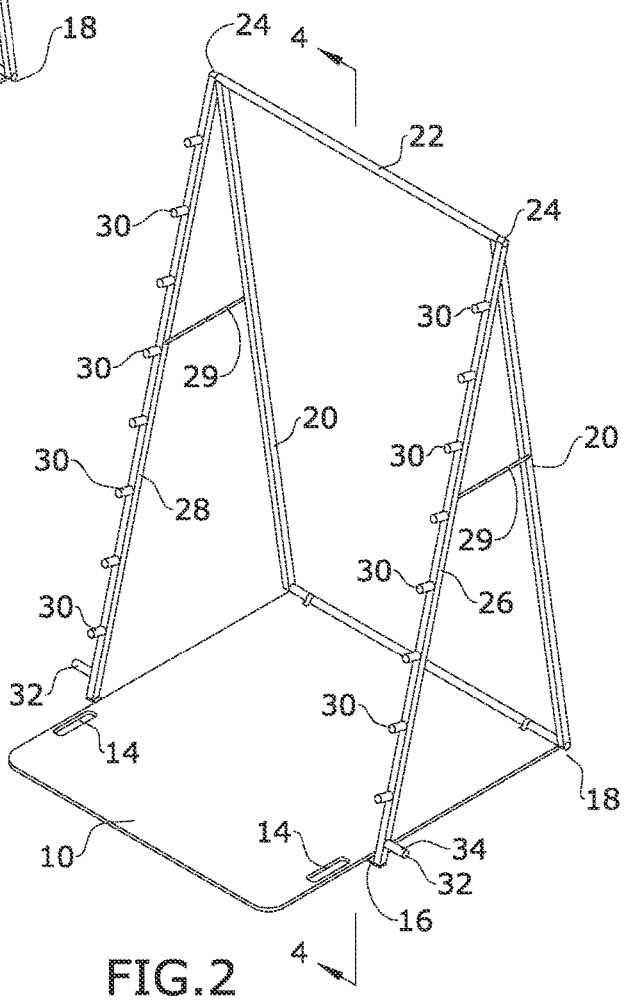
FIG. 2 is a perspective view of an exemplary embodiment of the present invention.
Figure 3:
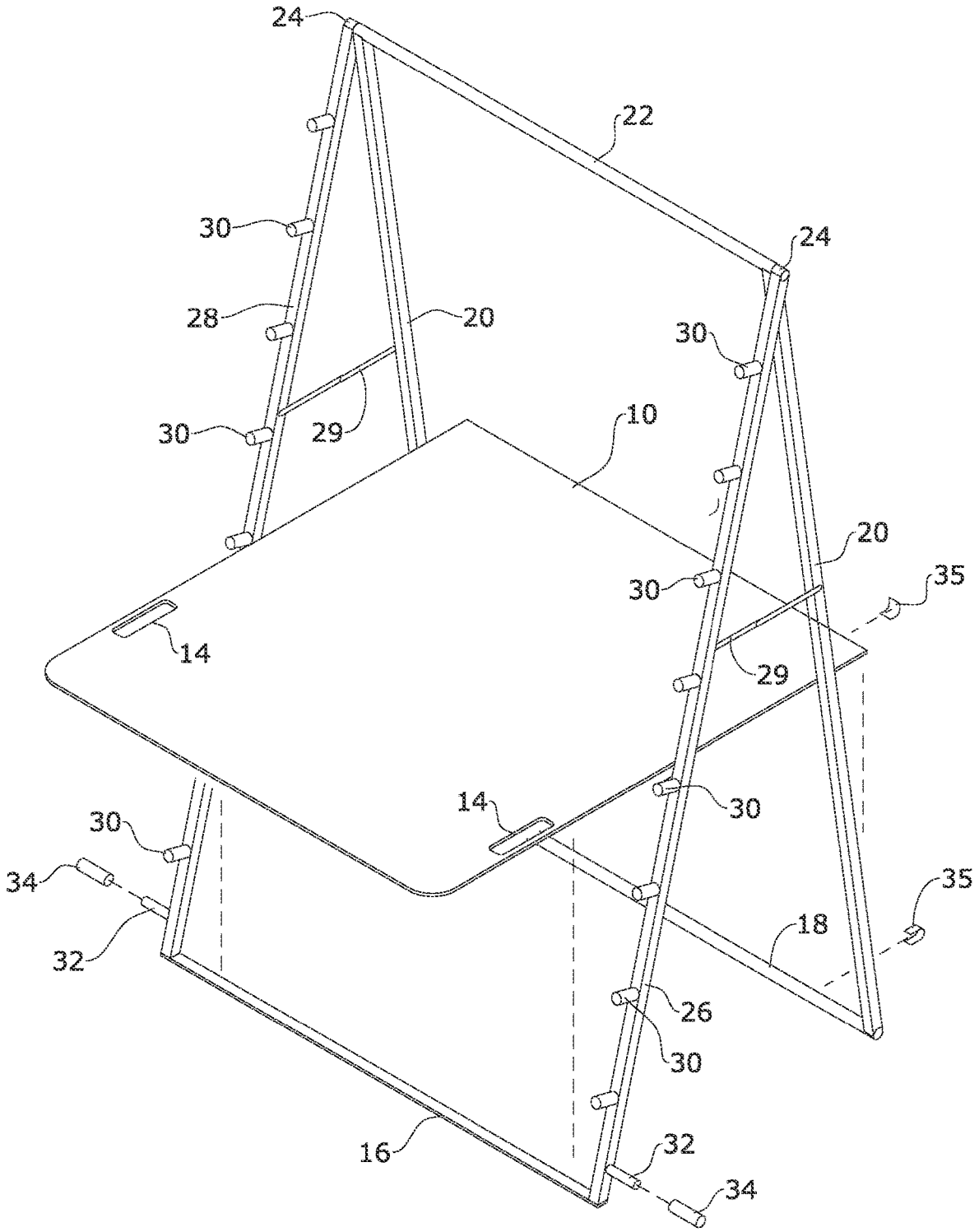
FIG. 3 is an exploded perspective view of an exemplary embodiment of the present invention.
Figure 4:
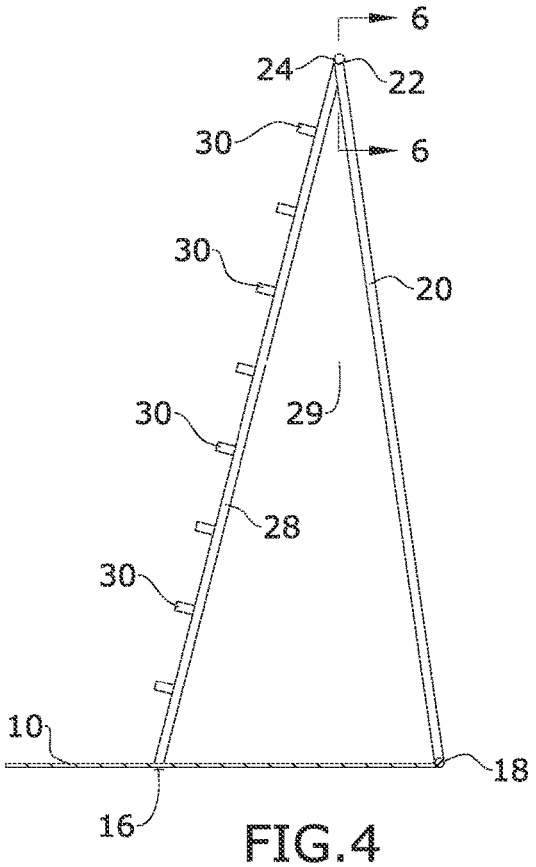
FIG. 4 is a section view of an exemplary embodiment of the present invention, taken along the line 4-4 of FIG. 2.
Figure 5:
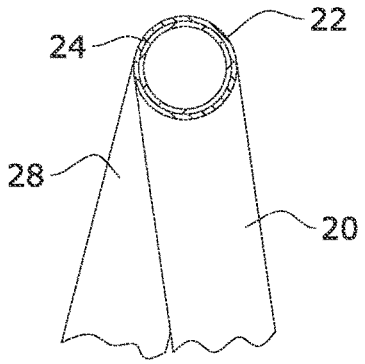
FIG. 5 is a detailed section view of FIG. 4, illustrating the intersection of a front leg 28 and an operatively associated rear leg 20 by way of a top hinge bar 24.
Figure 6:
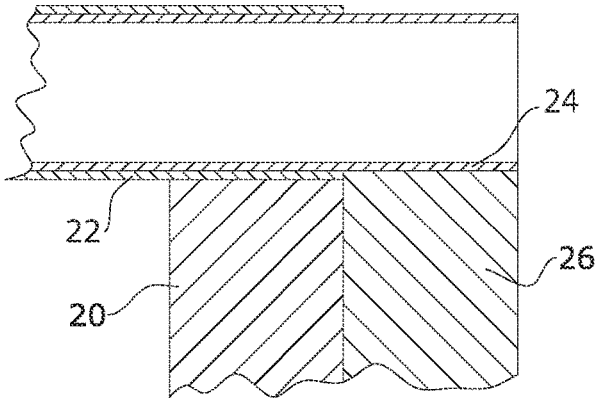
FIG. 6 is a detailed section view taken along the line 6-6 in FIG. 4, illustrating the intersection of the front leg 26 and the rear leg 20 on the top hinge bar 24, wherein the top hinge bar 24 runs through the crossbar 22.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a sleeved hinge bar that interconnects a pair of scissor legs so that they move, in unison, between a closed position/collapsed condition and an open position/expanded condition supporting the sleeved hinge bar along and elevated above a supporting surface. Each pair of legs has a front leg and a rear leg. The rear legs interconnect along their distal ends by a rear support bar. A base platform may be pivotably connected to the rear support bar by hinge straps so that the base platform moves between a vertical position in the collapse condition and a horizontal position in the expanded position so that a user may be supported by the base platform during exercise routines that rely on engaging the front legs.

Referring now to FIGS. 1-4, an embodiment of the present invention embodies exercise equipment 100. Exercise equipment 100 includes a crossbar 22, two pairs of rear and front legs 20 and 26/28, one pair of legs pivotably connected to each end of the crossbar 22, and a base 10.

The front legs 26 and 28 may be connected by their distal ends by way of a front surface bar 16, while the rear legs 20 may be connected by their distal ends by way of a rear surface bar 18.

Figure 7:
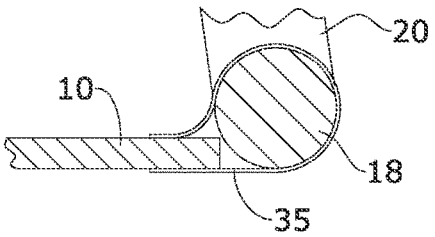
FIG. 7 is a detailed section view of FIG. 4, illustrating a base 10 being held to the rear support bar 18 by the hinge straps 35.
Figure 8:
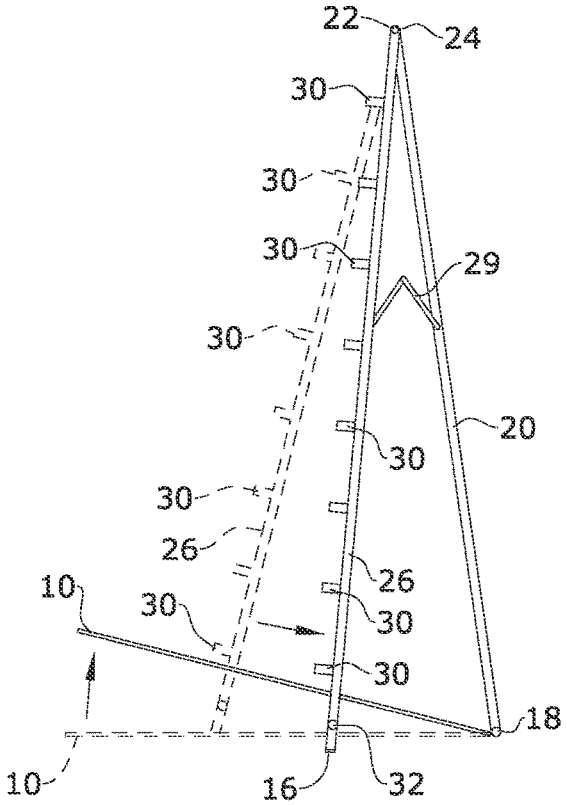
FIG. 8 is a side elevation view of an exemplary embodiment of the present invention, shown moving toward a collapsed condition, wherein the base 10 being lifted up and the front legs 26 and 28 being folded towards the rear legs 20, wherein simultaneously the ladder hinges 29 fold, enabling this movement.
Figure 9:
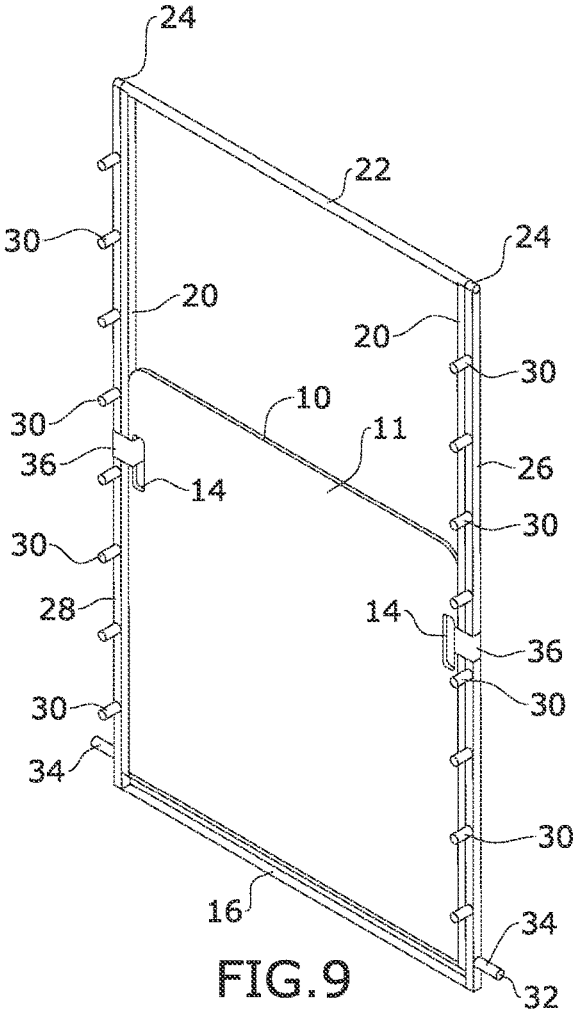
FIG. 9 is a perspective view of an exemplary embodiment of the present invention, shown in the collapsed condition, wherein storage traps 36 attach the base 10 to the front legs 26 and 28 by running through the handles 14.

The base has handles 14 for manipulation as well has engaging storage straps 36 in the collapsed condition. The base 10 rests on top of a front surface bar 16 and a rear surface bar 18. One or more hinge straps 35 connect a first edge of the base 10 to the rear surface bar 18. Each hinge strap 35 may have a comma or 9-shape, wherein that shape is defined by strap material hat is rigid. The circular head of the 9-shape receives rear support bar 18, while the open end of the leg of the 9-shape slidably receives an edge of the base 10, as illustrated in FIG. 7. The mouth of the base may be biased as shown in FIG. 7, though with enough flexibility to allow the girth of the rear support bar 18 to be pushed through. The material of the hinge strap 35 along it to pivot about the rear support bar 18 (the longitudinal axis thereof being the axis of rotation, thereby enabling the base 10 to be pivoted upward, about the hinge strap 35, from the horizontal position to the vertical position.

In one embodiment, the crossbar 22 may be a sleeve through which a hinge bar 24 is received, wherein the hinge bar 24 protrudes from opposing ends of the sleeve/crossbar 22. The front legs 26 and 28, respectively, may be joined to the opposing ends of the hinge bar 24, which are protruding from the sleeve/crossbar 22. The rear legs 20 may be joined to crossbar 22. Since the crossbar 22 can rotate relative to the hinge bar 24, the rear legs 20 pivot relative to the front legs 26, 28. A ladder hinge 29 joins a middle portion of the front right leg 26 to a middle portion of the rear leg 20. Another ladder hinge 29 joins a middle portion of the front left leg 28 to a middle portion of the other rear leg 20.

The front right leg 26 and the front left leg 28 each have a plurality of pegs 30 extending outwards away from the rear legs 20, toward a front portion of the exercise equipment 100. Two bearing pegs 32, one on each front leg 26 and 28, extend laterally outward, parallel with and away from the front support bar 16. Each bearing peg 32 may be covered by bearings 34. A user 38 may attach resistance bands 42 to the bearings 34 and then connect it to a workout bar 40 as best seen in FIG. 1. The resistance bands 42 may also attach to the plurality of pegs 30 for various workouts of the user 38.

In one method of use, a bar may be placed level across a peg or pegs. An elastic resistance band may be secured to each end of the bar, looped around a bearing, and secured to another peg on the machine. The bar may then be lifted off the pegs for exercise. The bar may be pushed or pulled within the machine. Resistance bands of varying thickness give the user more or less of a load to heave. Standing on the platform may give the user several exercise choices such as a deadlift, bicep curls, squats, military press, and more. When using a standard bench, the user can perform a bench press, and if using a chair, the user may perform a shoulder press and more. The user may also use a crossbar to perform chin ups and pull ups, or the user may secure a resistance band around the top bar and perform lat (latissimus dorsi) pulldowns, triceps pushdowns and more. Various handheld accessories may also be used in conjunction with the equipment.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. An exercise equipment comprising:

a sleeved hinge bar interconnecting a pair of scissor legs so that they move, in unison, between a collapsed condition and an expanded condition supporting the sleeved hinge bar along and elevated above a supporting surface;

each of the pair of scissor legs comprise a front leg and a rear leg;

a rear support bar interconnects the rear legs along their distal ends;

a platform may be pivotably connected to the rear support bar so as to be movable between a vertical position in the collapse condition and a horizontal position in the expanded position;

one or more hinge straps operatively associating the platform with the rear support bar, wherein each hinge strap of the one or more hinge straps define a hollow 9-shape, wherein the hollow 9-shape comprises a circular head configured to receive the rear support bar and an open end of a leg configured to slidably receive an edge of the platform, whereby the platform is configured to support a user above the supporting surface during an exercise routine engaging each of the front legs of the pair of scissor legs.

2. The exercise equipment of claim 1, wherein each hinge strap of the one or more hinge straps pivots about the rear support bar enabling movement of the platform between the horizontal position to the vertical position.

3. The exercise equipment of claim 2, further comprising a front support bar interconnecting each of the front legs of the pair of scissor legs so that when the platform is in the horizontal position it is resting on both the front support bar and rear support bar.

4. The exercise equipment of claim 3, further comprising a plurality of pegs spaced apart along a front face of each front leg of the pair of scissor legs.

5. The exercise equipment of claim 4, further comprising a bearing peg extending laterally outward from each front leg of the pair of scissor legs.

6. The exercise equipment of claim 5, further comprising a bearing covering each bearing peg.

7. The exercise equipment of claim 6, wherein the platform has a handle on each opposing side of the platform.

8. The exercise equipment of claim 7, further comprising, for each handle of the platform, a storage strap dimensioned to pass through the handle and around one of the pair of scissor legs.

* * * * *